US010487464B2

(12) United States Patent
Rich

(10) Patent No.: US 10,487,464 B2
(45) Date of Patent: Nov. 26, 2019

(54) TRAFFIC CONE

(71) Applicant: Steven Rich, Montvale, NJ (US)

(72) Inventor: Steven Rich, Montvale, NJ (US)

( * ) Notice: Subject to any disclaimer, the term of this patent is extended or adjusted under 35 U.S.C. 154(b) by 131 days.

(21) Appl. No.: 15/675,771

(22) Filed: Aug. 13, 2017

(65) Prior Publication Data

US 2018/0195245 A1 Jul. 12, 2018

Related U.S. Application Data

(63) Continuation-in-part of application No. 15/406,744, filed on Jan. 15, 2017, now Pat. No. 10,323,370, which is a continuation of application No. 29/590,428, filed on Jan. 10, 2017, now Pat. No. Des. 854,957.

(51) Int. Cl.

| | |
|---|---|
| ***E01F 9/654*** | (2016.01) |
| ***G08G 1/0955*** | (2006.01) |
| ***E01F 9/615*** | (2016.01) |
| ***E01F 9/688*** | (2016.01) |

(52) U.S. Cl.

CPC ..... *E01F 9/654* (2016.02); *E01F 9/615* (2016.02); *E01F 9/617* (2016.02); *E01F 9/688* (2016.02); *G08G 1/0955* (2013.01)

(58) Field of Classification Search

CPC . E01F 9/654; E01F 9/615; E01F 9/688; E01F 9/617; G08G 1/0955

See application file for complete search history.

(56) References Cited

U.S. PATENT DOCUMENTS

| | | | |
|---|---|---|---|
| 1,643,118 | A | 9/1927 | Hahn |
| 2,719,505 | A | 10/1955 | Blumenthal |
| 2,817,308 | A | 12/1957 | Scanlon |
| 2,957,444 | A | 10/1960 | Boettler |
| 3,132,624 | A | 5/1964 | Shoemaker |
| 3,212,415 | A | 10/1965 | Bryd |
| 3,247,823 | A | 4/1966 | Buck et al. |

(Continued)

FOREIGN PATENT DOCUMENTS

| | | |
|---|---|---|
| CA | 2257766 A1 | 8/1999 |
| CN | 201276678 | 7/2009 |

(Continued)

OTHER PUBLICATIONS

Anonymous, "Hollow Orange Cone by SafetySign.com -X5654", website, Jun. 17, 2015, http://www.safetysign.com/products/p5019/hollow-orange-cone.

(Continued)

*Primary Examiner* — Justin Seo
*Assistant Examiner* — Tania C Courson
(74) *Attorney, Agent, or Firm* — Werschulz Patent Law, LLC; Patricia P. Werschulz, Esq.

(57) ABSTRACT

A modular traffic cone assembled from a flat sheet and a dish that stores in a minimum of space. In one embodiment, translucent traffic cone has enhanced visibility through a light seated on a platform inside the translucent cone. In one embodiment, the modular traffic cone is included in a traffic directing kit comprising a translucent flat sheet, a dish and a platform, the sheet, the dish and the platform forming the traffic cone. The kit may also include ballast and the light for seating inside the traffic cone. A method of assembly for the traffic cone and the kit is disclosed.

11 Claims, 6 Drawing Sheets

(56) References Cited

U.S. PATENT DOCUMENTS

| | | | | |
|---|---|---|---|---|
| D207,037 | S | 2/1967 | Dawson | |
| D212,134 | S | 8/1968 | Dawson | |
| 3,451,368 | A * | 6/1969 | Keats | E01F 9/688 116/63 C |
| 3,596,628 | A | 8/1971 | Wright | |
| 3,809,007 | A | 5/1974 | Brown | |
| D235,744 | S | 7/1975 | England | |
| D235,746 | S | 7/1975 | England | |
| 4,083,033 | A | 4/1978 | Kulp et al. | |
| 4,466,376 | A | 8/1984 | Wells | |
| D295,026 | S | 4/1988 | Lin | |
| 4,889,067 | A * | 12/1989 | Provence, Jr. | E01F 9/688 116/63 C |
| D315,874 | S | 4/1991 | DeCaro | |
| D317,580 | S | 6/1991 | Thurston | |
| 5,225,254 | A | 7/1993 | Foulke | |
| 5,287,822 | A | 2/1994 | Anderson | |
| 5,336,536 | A | 8/1994 | Oberzan | |
| D411,810 | S | 7/1999 | Stockman | |
| 5,993,105 | A | 11/1999 | Chan | |
| 6,014,941 | A | 1/2000 | Bent et al. | |
| 6,247,424 | B1 | 6/2001 | Huang | |
| D462,286 | S | 9/2002 | Perelli | |
| 6,928,952 | B2 | 8/2005 | Garcia | |
| 6,929,419 | B1 | 8/2005 | Kuo | |
| 7,007,630 | B2 | 3/2006 | Garcia | |
| 7,056,055 | B1 | 6/2006 | Kuo | |
| 7,338,229 | B1 * | 3/2008 | Kuo | E01F 9/688 116/63 C |
| D579,369 | S | 10/2008 | Spataro | |
| 7,513,212 | B2 | 4/2009 | Dvoracek | |
| D597,432 | S | 8/2009 | Auberger | |
| 7,677,831 | B2 * | 3/2010 | Kulp | E01F 9/688 116/63 C |
| 8,770,137 | B2 | 7/2014 | Kuo | |
| 8,925,477 | B2 * | 1/2015 | Wang | E01F 9/654 116/63 C |
| 9,120,259 | B2 * | 9/2015 | Kuo | B29C 45/1418 |
| 9,493,919 | B2 | 11/2016 | Handy | |
| 9,494,919 | B2 | 11/2016 | Handy | |
| 9,512,578 | B1 | 12/2016 | Dvoracek | |
| D778,194 | S | 2/2017 | Rich | |
| D791,001 | S | 7/2017 | Rich | |
| 9,797,102 | B2 * | 10/2017 | Maus | E01F 9/654 |
| 2004/0060499 | A1 | 4/2004 | Penque | |
| 2004/0146677 | A1 * | 7/2004 | Boyd | E01F 9/619 428/36.91 |
| 2004/0218381 | A1 * | 11/2004 | Sawyer | E01F 9/688 362/157 |
| 2007/0113774 | A1 | 5/2007 | Kuo | |
| 2007/0237578 | A1 * | 10/2007 | Boyd | E01F 9/608 404/14 |
| 2008/0011221 | A1 * | 1/2008 | Dvoracek | E01F 9/688 116/63 C |
| 2010/0107964 | A1 * | 5/2010 | Wang-Lee | E01F 9/688 116/63 C |
| 2015/0231819 | A1 | 8/2015 | Wang | |
| 2016/0348325 | A1 | 12/2016 | Chi | |
| 2018/0195244 | A1 * | 7/2018 | Rich | E01F 9/654 |

FOREIGN PATENT DOCUMENTS

| | | | |
|---|---|---|---|
| EP | 0141564 | A2 | 5/1985 |
| FR | 2746119 | A1 | 9/1997 |
| GB | 981074 | A | 1/1965 |
| GB | 1058881 | | 2/1967 |
| GB | 2108182 | | 5/1983 |
| JP | 2003206515 | | 7/2003 |
| JP | 2004257240 | A | 9/2004 |
| JP | 2005113391 | A | 4/2005 |
| JP | 2007249159 | A | 9/2007 |
| TW | 200940787 | A | 10/2009 |

OTHER PUBLICATIONS

Anonymous, "Home of Disposable Traffic Cones, Disposable Safety Cone Products", website, Jun. 29, 2015, http://www.safetycones.net.

Anonymous, "Orange, Yellow, Lime Green Reflective PVC Road Cone Traffic Products", website, Jun. 12, 2015, Zhejiang Sanmen Eastsea Rubber Factory, URL: http://zjeastsea.en.made-in-china.com/product/aXDnvgmbHlhS/China-Orange-Yellow-Lime-Green-Reflective-PVC-Road-Cone-Traffic-Products.html.

Anonymous, Disposable traffic cones safety barricades traffic control for job sites work area or public events. website, Disposacone®, www.disposacone.com, Jun. 29, 2015.

* cited by examiner

TRAFFIC CONE

CROSS-REFERENCE TO RELATED APPLICATIONS

This application is a continuation-in-part utility application of the nonprovisional utility application, Ser. No. 15/406,744 filed in the United States Patent Office on Jan. 15, 2017, which is a continuation-in-part of the design patent application, Ser. No. 29/590,428 filed in the United States Patent Office on Jan. 10, 2017 and claims the priority thereof and is expressly incorporated herein by reference in its entirety.

TECHNICAL FIELD

The present disclosure relates generally to a traffic cone. More particularly, the present disclosure relates to a modular lighted traffic cone, a traffic directing kit and a method of assembly thereof.

BACKGROUND

Traffic cones direct people and traffic to follow a specific path or to avoid certain areas. Law enforcement and highway construction personnel use traffic cones to block off areas as well as forcing people to detour around.

Traffic cones are useful to retailers and realtors by either drawing attention to certain locations such as property for sale or special bargains. Tree surgeons block off area under trees as they go about pruning or felling trees, keeping the public safe from falling debris. Cleaning crews block off areas that are undergoing cleaning and may be wet and dangerous.

Traffic cones intended for outdoor use are weighted on the bottom and are generally unitary in structure. They stack one on top the other when they are stored or transported, taking up a lot of space. In short, they are bulky and unwieldy, taking up large volumes in car trunks, truck beds and storage facilities. Indoor cones are generally folding triangles that are lightweight. They are flimsy and useless outdoors where the elements can easily flatten them.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a modular traffic cone that stores in a minimum of space. Accordingly, an aspect of an example embodiment in the present disclosure provides a traffic cone assembled from a flat sheet and a dish.

A further aspect of an example embodiment in the present disclosure is to provide a traffic cone with enhanced visibility. Accordingly, the present disclosure provides a translucent traffic cone having a platform inside for supporting a light that enhances the traffic cone visibility.

Another aspect of an example embodiment in the present disclosure is to provide a kit for directing traffic. Accordingly, the present disclosure provides a kit comprising a translucent flat sheet, a dish, a platform, the sheet, the dish and the platform forming a traffic cone, as well as ballast and a light configured for placing inside the traffic cone.

Accordingly, the present disclosure describes a modular traffic cone assembled from a flat sheet and a dish that stores in a minimum of space. The dish is stackable with additional dishes. The translucent traffic cone has enhanced visibility through a light seated on a platform inside the translucent cone. In one embodiment, the modular traffic cone is part of a traffic directing kit comprising a translucent flat sheet, a dish and a base platform, the sheet, the dish and the platform forming a traffic cone, ballast and the light for seating inside the traffic cone. A method of assembly the traffic cone and the kit is disclosed.

The present disclosure addresses at least one of the foregoing deficiencies in the prior art. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
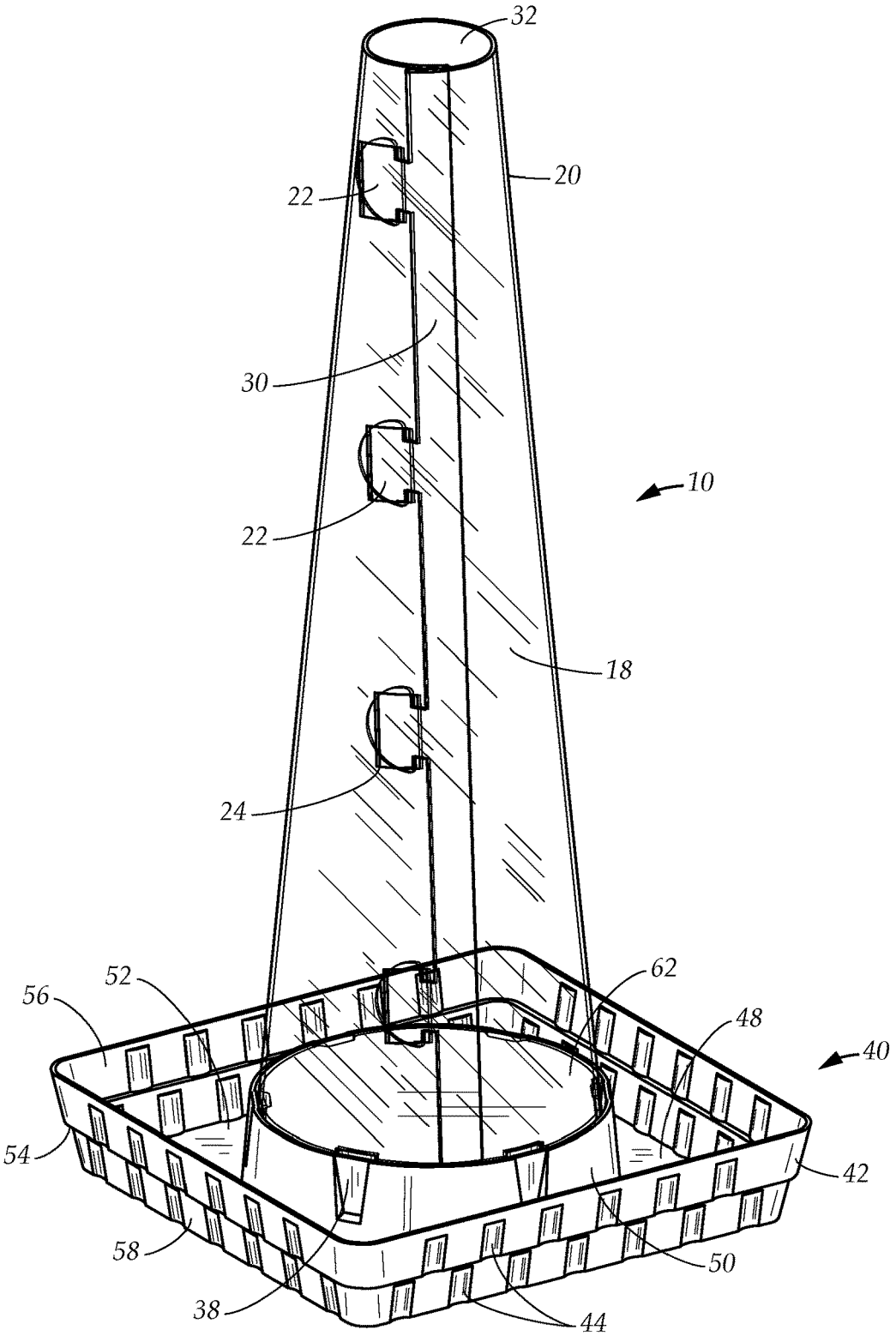
FIG. 1 is a perspective view of an example embodiment of an assembled traffic cone.
Figure 3:
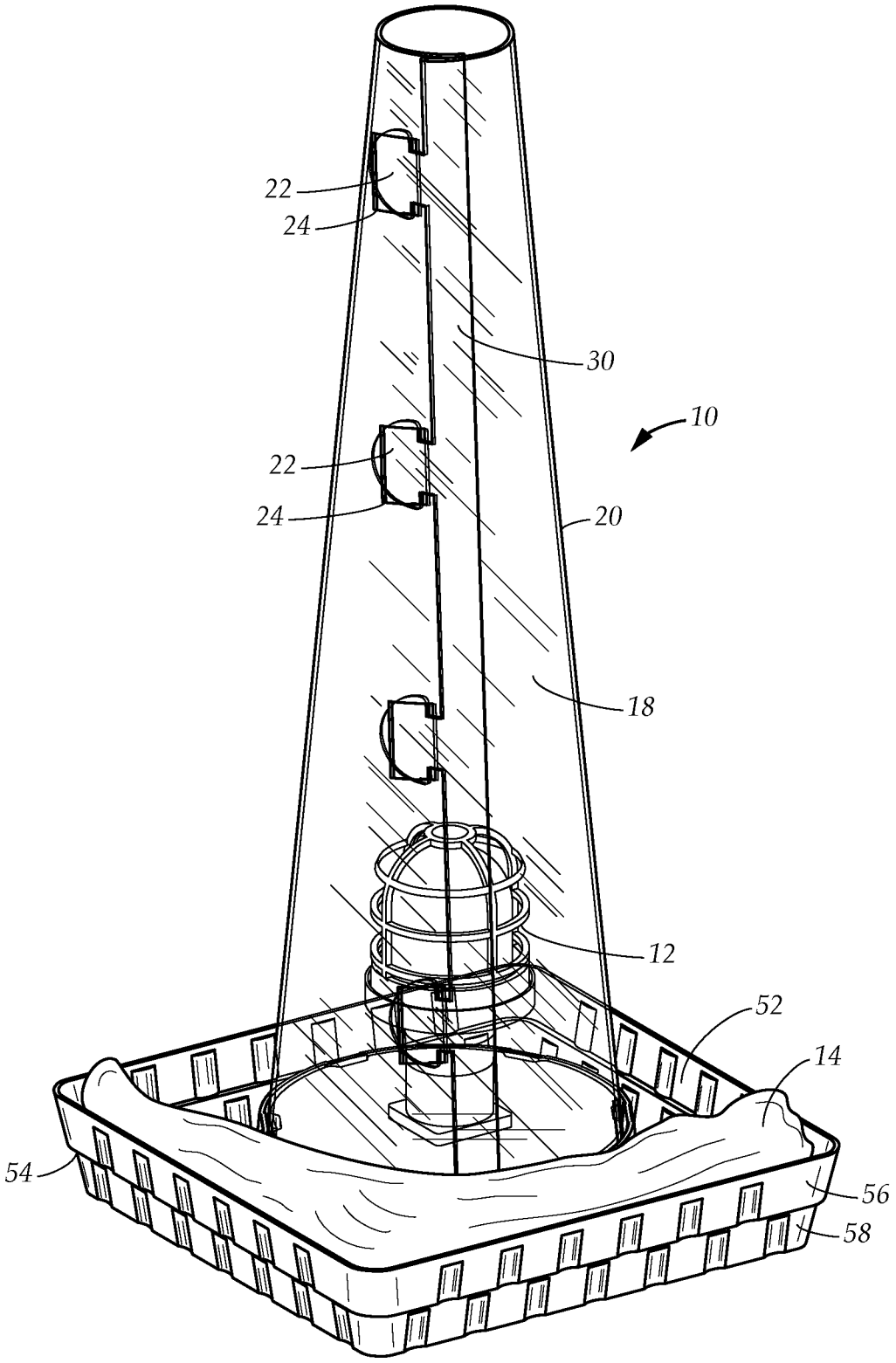
FIG. 3 is a perspective view of an example embodiment of an assembled traffic cone kit.

FIGS. 1 and 3 illustrate an example embodiment of an assembled traffic cone 10. The assembled traffic cone 10 has a frustoconical member 20 disposed within a dish 40. The frustoconical member 20 is frustoconical in shape with a flat circular apex 32 and is selectively formed from a flat sheet 18.

Figure 4:
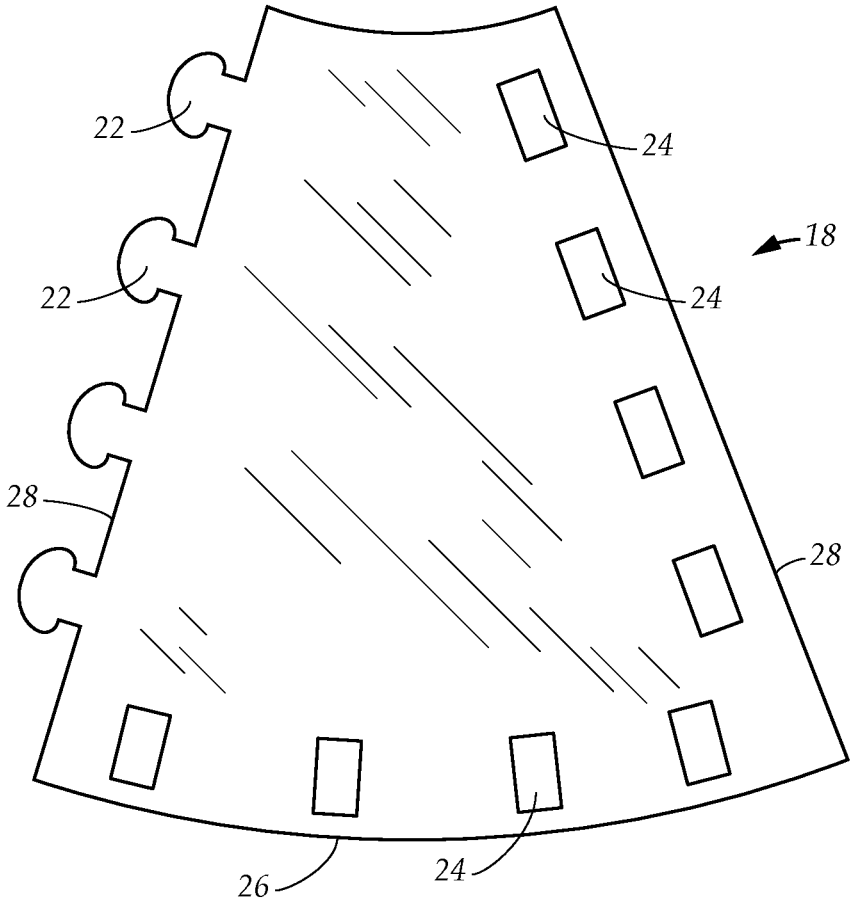
FIG. 4 is a top plan view of an example embodiment of a flat sheet for forming a frustoconical member of the traffic cone.

FIG. 4 shows the flat sheet 18. The flat sheet has a pair of sides edge 28, a first side edge 28 having a plurality of tabs 22 and a second side edge 28 having a plurality of adjacent slots 24 aligning with the tabs 22, the slots configured for inserting the tabs to form the frustoconical member 20 shown in FIGS. 1-3. The sheet 18 forming the frustoconical member has a bottom edge 26 and a plurality of slots 24 adjacent to the bottom edge.

In one example embodiment, the flat sheet 18 is translucent so that the frustoconical member 20 is translucent when it is formed. The term "translucent" means allowing light to pass through, not opaque, not necessarily transparent but includes transparent material. Translucent includes tinted materials. As a non-limiting example, the frustoconical member 20, may have a color such as bright orange or yellow to increase visibility of the traffic cone 10, but still be translucent.

Figure 2:
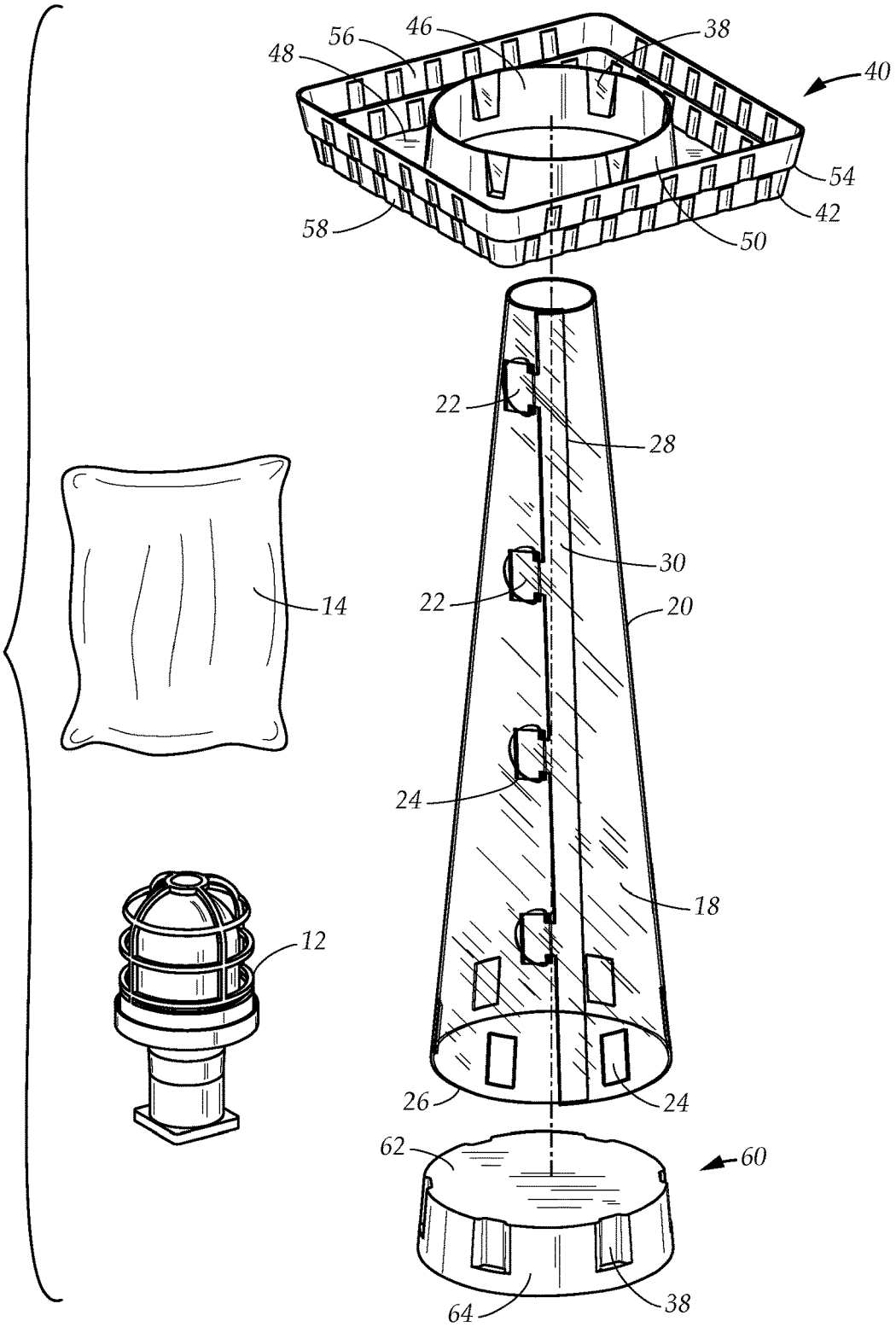
FIG. 2 is a perspective view of an example embodiment of a traffic cone kit.

Referring to FIGS. 1-3, the dish 40 has an external perimeter wall 42 and a floor 48. The dish 40 has a center circular opening 46 surrounded by an internal wall 50 extending upwardly from the floor 48. The external perimeter wall 42 and the internal wall 50 form a trough 52.

In the drawings, the dish 40 is shown to have an external perimeter wall 42 that is square. The shape illustrated should not be construed as a limitation and the dish may be any shape such as a circle, a rectangle, a triangle, an oval and a hexagon as not limiting examples.

The frustoconical member 20 is formed when the tabs 22 on the first side edge 28 insert into the slots 24 on the second side edge 28 forming an overlap margin 30. In one example embodiment, the overlap margin 30 is inside the frustoconical member 20. The traffic cone 10 is formed by selectively disposing the frustoconical member 20 inside the center circular opening 46 of the dish 40.

The internal wall 50 of the dish 40 has a plurality of dimples 38. When the frustoconical member 20 inserts within the center circular opening 46, the dimples 38 of the internal wall 50 insert into the slots 24 adjacent to the bottom edge 26 of the frustoconical member 20.

The external perimeter wall 42 of the dish 40 has a ridge 54 forming an upper portion 56 and lower portion 58 of the external perimeter wall.

The external perimeter wall 42 has a plurality of ribs 44 allocated in the upper portion 56 and the lower portion 58 of the external perimeter wall, the ribs allocated such that ribs on the upper portion are offset from the ribs on the lower portion. The ribs 44 and the ridge 54 provide strength and stability to the dish so that ballast 14 can be added to the trough 52. In the drawings, ballast is shown as a sandbag, but this is not a limitation. The ballast can be a unitary piece such as a sandbag or a weight or even a rock or it can be loose such as pebbles, water, sand, dirt, small rocks or any handy material to weigh down the traffic cone in windy conditions.

In one example embodiment, the traffic cone 10 has the frustoconical member 20, the dish 40 as described hereinabove and a base 60. The base 60 has a topmost circular platform 62 atop a circular wall 64, the wall having have a plurality of dimples 38, substantially the same as the dimples 38 on the internal wall 50 of the dish 40.

The frustoconical member 20 is selectively disposed inside the center circular opening 46 of the dish 40 and over the circular wall 64 of the base 60, with the base 60 inserting inside the frustoconical member 20.

When the traffic cone is formed with the frustoconical member 20, the dish 40 and the base 60, a light 12 can selectively be placed on the platform 62 of the base 60 inside the frustoconical member 20. When the frustoconical member 20 is translucent, the light 12 acts an additional safety feature, providing a beacon. The light shown When the frustoconical member 20 inserts within the center circular opening 46, the dimples 38 of the internal wall 50 of the dish 40 insert through the slots 24 adjacent to the bottom edge 26 and further insert into the dimples 38 of the base 60.

In yet another example embodiment, the frustoconical member 20 can selectively be placed over the base 60 without the dish 40. The light can selectively be placed on the platform 62 and use the modified traffic cone can be used where and when ballast is not required.

FIG. 2 shows another example embodiment of the traffic cone as part of a traffic directing kit. The traffic directing kit comprises the frustoconical member 20, the dish 40, the base 60 and the light 12. Optionally, the kit may include ballast 14 such as a sandbag ballast 14, but other readily available ballast may be used as explained hereinabove.

Figure 5A:
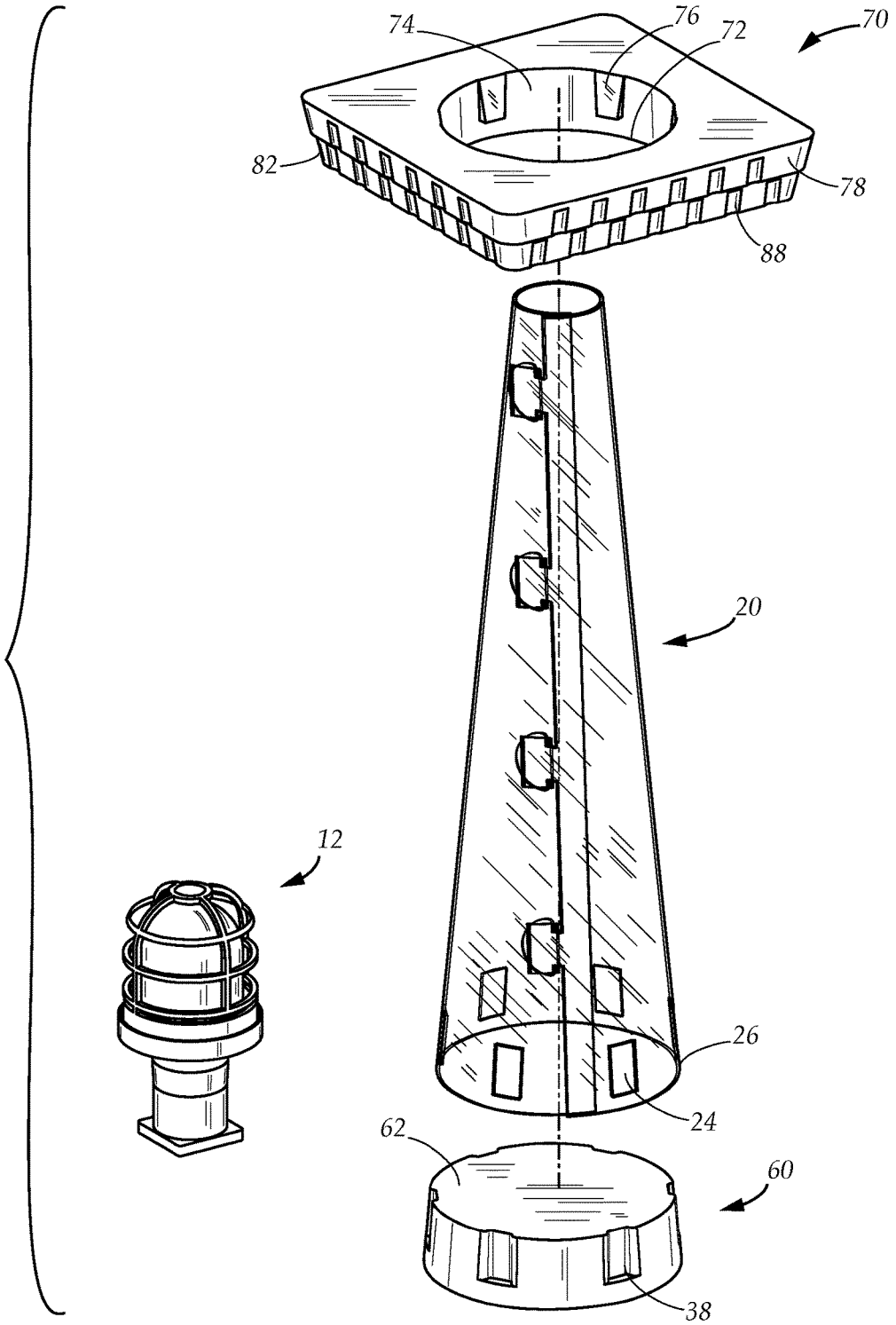
FIG. 5A is a perspective view of another example embodiment of an assembled traffic cone kit.
Figure 5B:
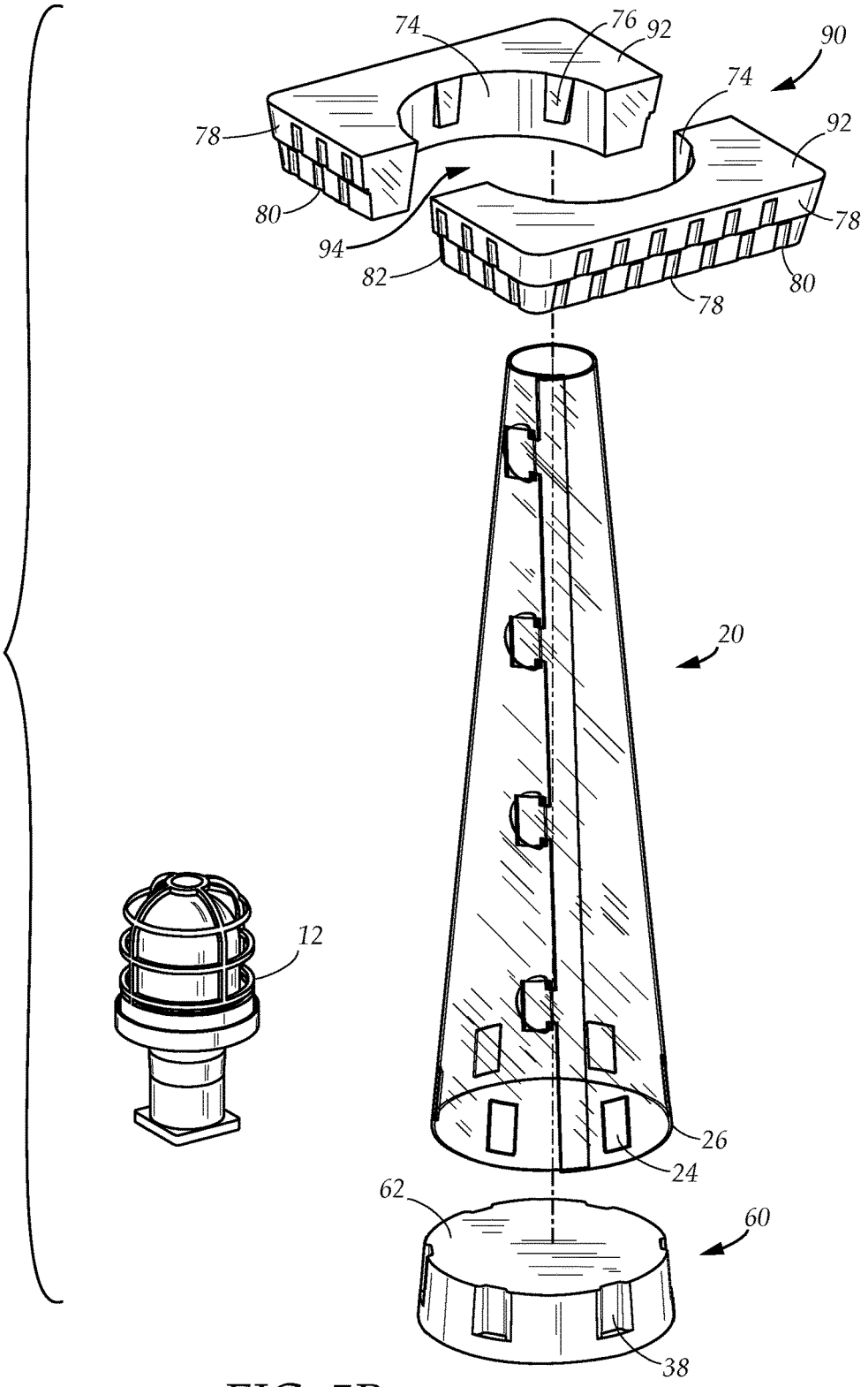
FIG. 5B is a perspective view of a further example embodiment of an assembled traffic cone kit.

FIGS. 5A and 5B illustrate further example embodiments of an unassembled traffic cone as part of further example embodiments of traffic directing kits. The unassembled traffic cone has the frustoconical member 20, described hereinabove, configured for disposing within a relatively low plinth 70 or a bifurcated low plinth 90 formed by a pair of members 92.

In FIG. 5A, the traffic directing kit comprises the frustoconical member 20, the plinth 70, the base 60 and the light 12. In FIG. 5B, the traffic directing kit comprises the frustoconical member 20, the bifurcated low plinth 90 formed by the pair of members 92, the base 60 and the light 12. In one example embodiment, the frustoconical member 20 is translucent.

Referring to FIG. 5A, the low plinth 70 has an external wall 78 and a center circular opening 72 forming an internal wall 74 and a plurality of dimples 76. In FIG. 5B, when the members 92 of the bifurcated low plinth 90 join, a center circular opening 94 formed from a pair of semicircular openings, each with the internal wall 74 with dimples 76 and an external wall 78.

In the drawings, the plinth 90 is shown to have an external perimeter wall 78 that is square. The members 92 of the bifurcated plinth 90 form the square external wall 78 when joined. The shape illustrated should not be construed as a limitation and the plinth may be any shape such as a circle, a rectangle, a triangle, an oval and a hexagon as not limiting examples.

To assemble the traffic cone as shown in FIG. 5A, the frustoconical member 20 is disposed inside the center circular opening 72 of the plinth 70. The base 60 is disposed inside the frustoconical member 20. When the frustoconical member 20 inserts within the center circular opening 72, the dimples 76 of the internal wall 74 insert into the slots 24 adjacent to the bottom edge 26 of the frustoconical member 20.

As shown in FIG. 5B, the members 92 of the bifurcated plinth 90 join and the frustoconical member 20 inserts within the center circular opening 94, the dimples 76 of the internal wall 74 insert into the slots 24 adjacent to the bottom edge 26 of the frustoconical member 20.

The external perimeter wall 78 of the plinth 70 and the bifurcated plinth 90 each has a ridge 82 and a plurality of ribs 88. The plinth 70 and the bifurcated plinth 90 are formed from a dense elastomer such as a non-limiting example of synthetic rubbers. The plinth 70 and bifurcated plinth 90 act as ballast for the traffic cone as well as providing a solid base.

In one example embodiment, unassembled traffic cone has the frustoconical member 20, the plinth 70 or the bifurcated plinth 90 as described hereinabove and a base 60.

The frustoconical member 20 is selectively disposed inside the center circular opening 72 of the plinth 70 or the opening 94 of the joined bifurcated plinth 90 and over the circular wall 64 of the base 60, with the base 60 inserting inside the frustoconical member 20.

When the frustoconical member 20 inserts within the opening 72 of the plinth 70 or the opening 94 of the joined bifurcated plinth 90, the dimples 76 of the internal wall 74 insert through the slots 24 adjacent to the bottom edge 26 of the frustoconical member 20 and further insert into the dimples 38 of the base 60 as described hereinabove. The light 12 can selectively be placed on the platform 62 of the base 60 inside the frustoconical member 20.

A method for forming the traffic cone 10 for directing traffic comprises assembling the frustoconical member 20 from the flat sheet 18 configured for forming a frustoconical shape, the flat sheet 18 having side edges 28, the first side edge having tabs 22 and the second side edge having adjacent slots 24 aligning with the tabs 22 by gathering the edges 28 towards each other and inserting said tabs 22 inside said slots 24 with the overlap margin 30 inside the frustoconical member 20, and placing the frustoconical member 20 into the center circular opening 46 of the dish 40 inserting the bottom edge 26 of frustoconical member 20 inside said internal wall 50 of the opening 46. The dimples 38 of the internal wall 50 insert inside the slots 34 adjacent to the bottom edge 26 of the frustoconical member 20.

In another example embodiment of the method described hereinabove, the method includes the step of inserting the base 60 inside the frustoconical member 20 and inserting the dimples 38 of the internal wall 50 of the dish 40 through the slots 24 adjacent to the bottom edge 26 of the frustoconical member 20, aligning and inserting the dimples 38 of the internal wall 50 of the dish 40 into the dimples 38 of the circular wall 64 of the platform 62, disposing the frustoconical member 20 between the base 60 and the dish 40.

Another example embodiment of the method described hereinabove includes placing ballast 14 inside the trough 52 of the dish 40 after the traffic cone 10 is assembled.

The method includes the step of selectively placing the light 12 atop the platform 62 of the base 60 inside the frustoconical member.

Another method for forming the traffic cone 10 for directing traffic comprises assembling the frustoconical member 20 as described hereinabove and placing the frustoconical member 20 into the center circular opening 72 of the plinth 70 inserting the bottom edge 26 of frustoconical member 20 inside said internal wall 74 of the opening 72. The dimples 76 of the internal wall 74 insert inside the slots 34 adjacent to the bottom edge 26 of the frustoconical member 20.

In another example embodiment of the method described hereinabove, the method includes the step of inserting the base 60 inside the frustoconical member 20 and inserting the dimples 76 of the internal wall 74 of the plinth 70 through the slots 24 adjacent to the bottom edge 26 of the frustoconical member 20, aligning and inserting the dimples 76 of the internal wall 74 of the plinth 70 into the dimples 38 of the circular wall 64 of the platform 62, disposing the frustoconical member 20 between the base 60 and the plinth 70.

The method includes the step of selectively placing the light 12 atop the platform 62 of the base 60 inside the frustoconical member 20.

Yet another method for forming the traffic cone 10 for directing traffic comprises assembling the frustoconical member 20 as described hereinabove, joining the members 92 of the bifurcated plinth 90 together and placing the frustoconical member 20 into the center circular opening 94 of the bifurcated plinth 90 inserting the bottom edge 26 of frustoconical member 20 inside said internal wall 74 of the opening 94. The dimples 76 of the internal wall 74 insert inside the slots 34 adjacent to the bottom edge 26 of the frustoconical member 20.

In another example embodiment of the method described hereinabove, the method includes the step of inserting the base 60 inside the frustoconical member 20 and inserting the dimples 76 of the internal wall 74 of the bifurcated plinth 90 through the slots 24 adjacent to the bottom edge 26 of the frustoconical member 20, aligning and inserting the dimples 76 of the internal wall 74 of the bifurcated plinth 90 into the dimples 38 of the circular wall 64 of the platform 62, disposing the frustoconical member 20 between the base 60 and the plinth 90.

The method includes the step of selectively placing the light 12 atop the platform 62 of the base 60 inside the frustoconical member 20.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a traffic cone, a traffic directing kit and method of assembly thereof. The disclosure is illustrated by example in the drawing figures, and throughout the written description. It should be understood that numerous variations are possible, while adhering to the inventive concept. Such variations are contemplated as being a part of the present disclosure.

What is claimed is:

1. A traffic cone, comprising:

a plinth having a center circular opening forming an internal wall; wherein the plinth is disposed at a bottom of a frustoconical member; and the frustoconical member formed from a flat sheet, the flat sheet having a first side edge having a plurality of tabs, said flat sheet having a second side edge having a plurality of adjacent slots aligning with the plurality of tabs of the first side edge, the tabs configured for inserting into the slots to form the frustoconical member, said frustoconical member selectively disposed inside the center circular opening of the plinth, wherein the frustoconical member having a bottom edge and a plurality of slots adjacent to the bottom edge, the internal wall of the plinth having a plurality of dimples, the dimples of the internal wall of the plinth inserting through the slots adjacent to the bottom edge the frustoconical member within the center circular opening of the plinth.

2. The traffic cone as described in claim 1, wherein the frustoconical member is translucent.

3. The traffic cone as described in claim 2, wherein the plinth is formed from a dense elastomer.

4. The traffic cone as described in claim 3, wherein the plinth is bifurcated and further comprises a pair of members, each member having a side having a semicircular opening, each member configured to join the other to form the plinth having the center circular opening.

5. A traffic cone, comprising:

a plinth having a center circular opening forming an internal wall; wherein the plinth is disposed at a bottom of a translucent frustoconical member; a base having a platform atop a circular wall; and the translucent frustoconical member selectively formed from a flat sheet, said flat sheet having a first side edge having a plurality of tabs, said flat sheet having a second side edge having a plurality of adjacent slots aligning with the plurality of tabs, the tabs configured for inserting into the slots to form said translucent frustoconical member, said translucent frustoconical member having a bottom edge configured with a plurality of slots adjacent to the bottom edge, said translucent frustoconical member disposed inside the center circular opening of the plinth and over the circular wall of the base, the internal wall of the plinth and the circular wall of the base have a plurality of dimples, the dimples of the internal wall of the plinth inserting through the slots adjacent to the bottom edge of the translucent frustoconical member and into the dimples of the base, the base inserting inside the translucent frustoconical member.

6. The traffic cone as described in claim 5, wherein the plinth is formed from a dense elastomer.

7. The traffic cone as described in claim 6, wherein the plinth is bifurcated and further comprises a pair of members, each member having a side having a semicircular opening, each member configured to join the other to form the plinth having the center circular opening.

8. A traffic directing kit, comprising:

a traffic cone further comprising a plinth, wherein the plinth is disposed at a bottom of a translucent frustoconical member; said plinth having a floor and a center circular opening forming an internal wall, said internal wall of the plinth having a plurality of dimples, said traffic cone further comprising a base having a platform atop a circular wall, the circular wall of the base have a plurality of dimples, said traffic cone further comprising the translucent frustoconical member selectively formed from a flat sheet, said flat sheet of said translucent frustoconical member having a first side edge having a plurality of tabs and a second side edge having a plurality of adjacent slots aligning with the tabs, the tabs configured for inserting into the slots to form the translucent frustoconical member, said translucent frustoconical member having a bottom edge and a plurality of slots adjacent to the bottom edge, said translucent frustoconical member disposed inside center circular opening of the plinth and over the circular wall of the base, the base inserting inside the translucent frustoconical member, the dimples of the internal wall of the plinth inserting through the slots adjacent to the bottom edge of the translucent frustoconical member and into the dimples of the base; and a light.

9. The traffic directing kit as described in claim 8, wherein the light sits on the platform of the base inside the translucent frustoconical member of the traffic cone.

10. The traffic cone as described in claim 9, wherein the plinth is formed from a dense elastomer.

11. The traffic cone as described in claim 10, wherein the plinth is bifurcated and further comprises a pair of members, each member having a side having a semicircular opening, each member configured to join the other to form the plinth having a center circular opening.

* * * * *